US010748374B2

(12) United States Patent
Saulino

(10) Patent No.: US 10,748,374 B2
(45) Date of Patent: Aug. 18, 2020

(54) PREDICTIVE COMPETITIVE SPORTS GAME SYSTEM

(71) Applicant: STATEMENTGAMES, INC., Farmingville, NY (US)

(72) Inventor: Marc P. Saulino, Farmingville, NY (US)

(73) Assignee: STATEMENTGAMES, INC., Farmingville, NY (US)

( * ) Notice: Subject to any disclaimer, the term of this patent is extended or adjusted under 35 U.S.C. 154(b) by 8 days.

(21) Appl. No.: 16/175,190

(22) Filed: Oct. 30, 2018

(65) Prior Publication Data

US 2019/0130694 A1 May 2, 2019

Related U.S. Application Data

(60) Provisional application No. 62/579,866, filed on Oct. 31, 2017.

(51) Int. Cl.
*G07F 17/32* (2006.01)

(52) U.S. Cl.
CPC ..... *G07F 17/323* (2013.01)

(58) Field of Classification Search
CPC .. G07F 17/323; G07F 17/3225; G07F 17/326; G07F 17/3272
USPC ..... 463/25
See application file for complete search history.

(56) References Cited

U.S. PATENT DOCUMENTS

| | | | | |
|---|---|---|---|---|
| 6,260,019 | B1 * | 7/2001 | Courts | G06Q 10/0639 705/7.31 |
| 8,532,798 | B2 * | 9/2013 | Ferraro, III | G06Q 90/00 700/91 |
| 2009/0054127 | A1 * | 2/2009 | Sweary | G07F 17/3295 463/16 |
| 2010/0144425 | A1 * | 6/2010 | Dannenberg | G06Q 40/04 463/25 |
| 2012/0115554 | A1 * | 5/2012 | Cairns | G07F 17/3288 463/1 |
| 2012/0270618 | A1 * | 10/2012 | Abramoff | G07F 17/3288 463/9 |
| 2014/0187302 | A1 * | 7/2014 | Ginsberg | A63F 13/00 463/9 |

* cited by examiner

*Primary Examiner* — Allen Chan
(74) *Attorney, Agent, or Firm* — One LLP

(57) ABSTRACT

A system and method providing a game for users to select predictive statements about a future sporting event that the user believes will become true. A user or gamer initiates the game contest by opening that game site and choosing a particular competitive sporting event from a list of competitive sporting events. The user is then presented with a pool of predictive statements relating to the chosen sporting event. Each contest has multiple users who compete with each other for points. After the conclusion of the competitive sporting event or events, based on the outcome and occurrences during the event, it is determined which of the predictive statements are true, and which are not. Points are awarded to users for true statements and the user with the most points is declared the winner.

18 Claims, 3 Drawing Sheets

PREDICTIVE COMPETITIVE SPORTS GAME SYSTEM

CROSS-REFERENCE TO RELATED APPLICATIONS

This non-provisional patent application is related to and claims priority from provisional patent application 62/579,866, filed Oct. 31, 2017.

FIELD OF THE INVENTION

This invention relates generally to sports-related games that are played on an internet-connected stationary device, such as a desk top computer, or portable device, such as a phone, tablet or laptop computer. More specifically, the disclosed and claimed subject matter relates to the field of computer games related to real sports event and connected to a central server or servers. The game can be played by multiple users who compete with one another over a predetermined period of time.

BACKGROUND OF THE INVENTION

In the past, internet-connected sports games relating to real sporting events focused on the "fantasy" of creating a group made up of individual players in each position who in the real world currently play for different franchises. In those games, the user or gamer typically selects a "team" of players from a pool of individual athletes currently playing in a league, e.g., National Football League, Major League Baseball, National Basketball Association, and National Hockey League. The gamer selects the fantasy team, as provided under the specific criteria of the particular sports game, for a particular period of time, such as one game, one week, or an entire season. The gamer's performance is judged by how well the individuals in the fantasy team performed during the period on their separate, individual teams in separate, different sporting events. More points or scores are awarded for good performances of the accumulated group of individuals added together, fewer points or lesser scores for less satisfactory performances. The accumulated points for the entire fantasy team is compared to the accumulated points of the fantasy teams of competing gamers. The gamer with the most points or highest scores among the competing gamers wins.

Fantasy team sports games have some disadvantages. For example, they do not reward a user or gamer for in-depth knowledge of a particular, possibly favorite team or subset of teams within a league or conference from which individual players are selected. Users and gamers are rewarded for knowing all the players on all the teams, and disadvantaged for greater depth of knowledge of some players, but only shallow or no knowledge of others.

A professional sports league may have thirty or more teams, and hundreds of active players. Many sports fans, however, focus their attention and conversations with peers, and therefore their knowledge, on their local or other favorite team, or on the particular division or conference of their local or other favorite team. Many fans focus their attention on learning and staying up-to-date on the details of how a team is trending, the status of a team's athletes' physical condition or injuries, how the team as a whole will perform under certain circumstances, or whether the team matches well or poorly against a particular opponent is very time consuming. Fantasy sports games do not recognize and reward those fans, or others who only have time and resources to focus on one team, or subset of teams within a professional or college sports league, conference or division.

Further, fantasy team sports do not adequately reward a user's or gamer's ability to predict real outcomes and occurrences of team performance in a single sporting event or throughout the course of a season. For example, a user could achieve a relatively high number of points by choosing a team made up of individual athletes that have unexpectedly good performances even when their teams performed poorly. A user could select a team make up of eleven football players who in a specific week performed better than expected. The user's fantasy team score would be relatively high despite the fact that perhaps all of their teams lost to their opponents. In other words, fantasy games do not adequately evaluate and reward a user's knowledge of a team or subset of a league or conference, or his or her ability to predict real world team outcomes or other real world aspects of the actual competitive sporting event (or series of events).

SUMMARY OF THE INVENTION

The present invention provides a system and method in which users choose among a predetermined set of predictive statements about a real, future sporting event. The game database and/or administrator (which is partially or entirely controlled by computer) generates a pool of predictive statements about the sporting event. The predictive statements may relate to the outcome of the event, e.g., the team performance or an individual performance during the game, or some other criteria that is unknown in advance of the event, but that will likely be determined by the event. The system or method may include pools of predictive statements of more than one competitive sporting event, such as a professional or college event of general interest to many potential users or gamers. For example, there may be fifteen pools of statements for fifteen professional competitive sporting events scheduled to occur in any given week of the regular professional football season.

A user or gamer initiates the contest by choosing a particular competitive sporting event from a list of competitive sporting events on the game site. The user is then presented by the website with a pool of predictive statements relating to the chosen sporting event. The statements may include general predictions such as identifying the prevailing team. The statements also may include more specific predictions, such as the differential between the two teams final scores. The statements could also include even more detailed predictions, such as the number of home runs a baseball team will hit, or the number of strike outs the pitchers will obtain or its batters will experience.

The user or gamer will be expected to choose only a subset of the pool of statements. The pool of statements may include mutually exclusive statements. For example, in the sporting event team Alpha versus team Beta, the pool of statements might include both the statement "Team Alpha prevails over Team Beta" and the statement "Team Beta prevails over Team Alpha." As only one of these statements can be true, and the other one will not be true, only a subset of the supplied pool of statements can be true. The user's ability to choose the predictive statements that turn out to be true, and to avoid choosing predictive statements that turn out to be untrue, is rewarded with more points and higher scores.

The user typically is not required to select all the required number of statements in a single visit to the game site. For example, the user can decide to select one, two, three or four statements when first presented with the pool of predictive statements. Subsequently, such as the next day, the user can add more statements, and return repeatedly to add statements until the prescriptive amount of statements are selected. The user also can swap statements up until the start of the competitive sporting event or a predetermined time prior to the start. For example, if a star athlete is questionable to start for a particular team, and then is announced as benched, or listed on a disabled list, a user can change applicable statements to take into account such late received information.

Each contest created by the database and/or administrator has multiple users who compete with each other for points. The database and/or administrator can set, but does not need to set, a minimum and maximum number of users for each contest. The minimum and/or maximum is known by the user at the time the user chooses to participate in a specific contest. The system can create multiple contests for a single sporting event, each contest having different criteria such as minimum and maximum number of players, amount of points achievable, number of statements needed to be chosen, or other criteria that applies and that would be known to a person of ordinary skill in the art.

After the user selects the prescribed number of predictive statements from the supplied pool of predictive statements, and the sporting event begins, no further changes to the statements can be made and the contest is "closed." At the conclusion of the competitive sporting event or events the system determines which of the predictive statements are true based on the outcome and occurrences during the event. Each user's set of selected statements submitted as part of a contest is evaluated for the number of true statements. Points are awarded for true statements. Selected statements that turn out not to be true are not rewarded with points.

As an option, the system may increase or decrease the number of point, i.e., weigh or adjust the total points, based upon other factors. For example, a user may be asked to list the statements according to the user's view of the most likely, or least likely, to be true. Under these circumstances, the user would list first the predictive statement he or she thought was most likely to be true. The user would list second the predictive statement that he or she thought was second most likely to be true. The user would list third the predictive statement he or she thought is the third most likely statement to be true. The entire list would be ordered this way reflecting the user's level of confidence of the selection of predictive statements from certain to lesser certain to unsure to not sure at all.

As another option, points may also be increased or decreased based upon the system's view of the likelihood of the statement becoming true. A predictive statement might be relatively likely or unlikely to be become true. For example, if an unbeaten professional football team is playing a team with only one or two wins, a prediction that the underdog will win is relatively unlikely to be true. A user who chooses such a predictive statement could be rewarded with an increased number of points if that statement becomes true. This would reward a user's ability to identify that the conventional thinking will not apply with respect to the subject matter of the statement. Conversely, a user's selection of a predictive statement that is relatively likely to be true, and it becomes true, might be rewarded with less points or some other downward point adjustment.

Weighing points allows users to select outlier statements (i.e., statements that are considered by knowledgeable persons in advance of the sporting event to be relatively or particularly unlikely to become true) with the expectation that the high risk of achieving no points is outweighed by the benefit of a higher payoff in points in the unlikely event the statement becomes true. This may be especially important for competitive sporting events in which one or both teams in the event underperform and the result is unusual, difficult to predict, or unexpected. In those circumstances, the point totals for each of the competing user group might be relatively low, but the ability of one or more users to still find and select true statements in the pool should be additionally recognized with points.

After points are assigned to the user, the system determines how the point totals for the group of users participating in a single contest compare to each other. The winner of the group is informed as to his or her rank among the group, as are the other participants. The winner may also be awarded with additional points or other bonus or prize for successfully competing against the other users in the group for that particular event.

The administrator maintains records of total points awarded to users, number of times the user won a contest, and other criteria relating to each contest. Users may be rewarded for point totals during a particular period or phase of a sports season. For example, users may be provided yet more points, or provided another form of bonus, if they successfully competed in a certain number of contests involving a particular team over the course of the regular season, or for a playoff series. Similarly, point totals for all users over a period of time, or meeting certain other criteria, could be compared, and those users with higher or highest totals could be rewarded with a bonus.

It is further contemplated within the scope of this invention that competitive sporting events not otherwise of national or even regional scope may be included. A group of users interested in such a sporting event could prepare and submit to the system a pool of statements relating to the event. The system would make the event available to that select group or a larger group of potential users. Users who participate would then select the event and choose a subset of predictive statements at some point prior to the event. The system would subsequently tally the points for each user and report the results to the group.

DETAILED DESCRIPTION OF THE PREFERRED EMBODIMENT

The predictive competitive sports game contemplated herein provides both a system and method. The following descriptions of preferred embodiments and examples are merely some of the ways the invention can be put into practice. Persons of skill in the applicable art understand that the invention could be also practiced in other ways without departing from the scope of the described invention.

Certain terms are intended to be consistently interpreted as follows. "User" or "gamer" or "player" means a person who receives a pool of predictive statements from the administrator and responds by identifying certain statements in the pool. A "competitive sporting event" is a professional, collegiate, recreational or other sporting event between teams or individuals. A "contest" or "tournament" is the competition between users. A contest or tournament can include one or more sporting events. A tournament may be comprised of multiple contests.

"Statements" are sentences that relate directly or indirectly to the competitive sporting event. A "predictive statement" is a statement that predicts an outcome of a sporting event or other occurrence during or directly or indirectly related to the sporting event. A "pool" of statements is a group of statements from which a subset will be selected by a user during a contest. "Selecting" a statement means indicating in any way that the user is identifying the statement as a prediction of a future outcome or other occurrence. "Participants" are users or gamers in a contest. A "credit" or "point" is a unit of virtual currency typically to be "paid" by a user to enter a particular contest or tournament, or received by a user. An "award" or "reward" is the assignment of credits or points typically for winning a contest or tournament. Other terms used herein not specifically defined are intended to be given their plain and ordinary meaning.

Figure 1:
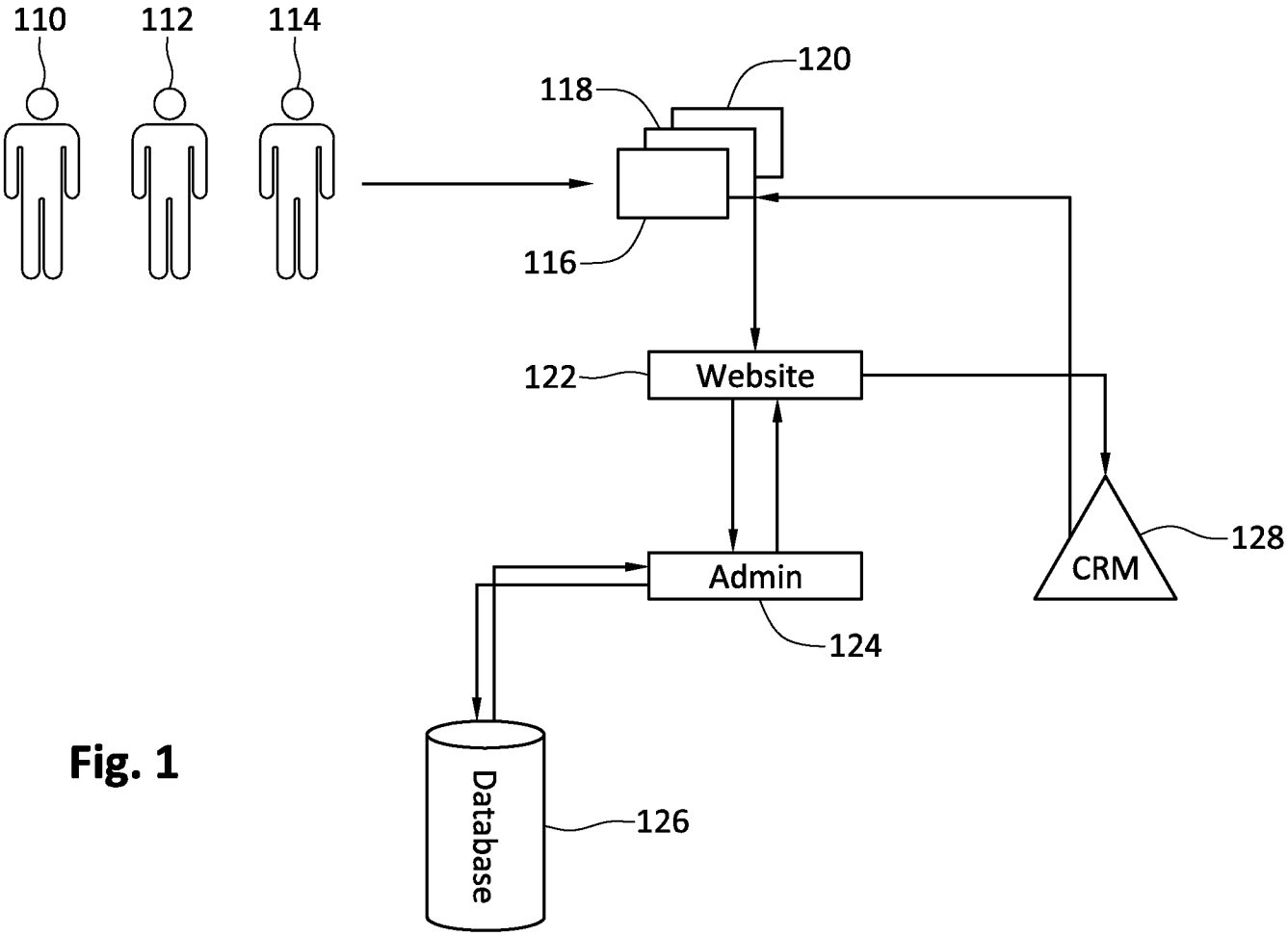
FIG. 1 shows a schematic drawing of an embodiment of the inventive system and method.

With reference to FIG. 1, system 100 provides an ability for users or gamers 110, 112 and 114 to engage in a contest with each other. Users 110, 112 and 114 have access to and use devices 116, 118 and 120 to communicate with the internet through well known means. The devices can be mobile internet connected, hand-held devices, such as smart phones or tablets, as well as laptop or desktop computers, or other apparatus containing a keyboard and/or touchscreen, that allows a user to interact with websites on the internet.

The internet-connected user 110 can connect with and gain access to the website 122 through user's device 116. Once user 110 engages the website 122, he or she may be required to log into an account or register to gain access to the content available through the website. This is typically done with an active, valid email address and a password, as is well known in the art.

Once an account is created, the user 110 can review his performance history and the points, credits or money associated with his account. Typically, initial credits can be awarded as a premium for registering, by providing a promotional number or other identifier, or by use of a credit card. Credits can be added by use of a credit card or earned through participating in the contests. Optionally, points and credits can also be obtained periodically as a premium for logging onto the website at a certain rate (once a day, certain number of times per week, etc.). The number of points or credits awarded in this fashion can be controlled by a random event, such as the user's virtual spinning of a wheel with six segments, each one corresponding to the amount of points or credits awards as the premium.

The website 122 and content available on the website 122 is controlled by and interacts with an administrator 124. The administrator is a server-based computer, preferably operated through a cloud-based system, that interacts with internet-connected devices, as is standard and well-known in the art. The website may exist on the same server as the administrator, or on a separate server, but is in communication with the administrator and with internet connected devices.

The administrator 124 is compiled by and exchanges information with the database 126. The database includes a series of modules, preferably nine. The modules preferably each have at least two structures wherein data is stored and can be accessed with permission from the administrator. Preferably the modules are (1) user, (2) authentication and authorization, (3) contest, (4) config and reference tables, (5) tournament and professional games, (6) teams and statements, (7) roles and permission scheme, (8) spin wheel and CMS, and (9) product and subscription.

The user module stores the personal information of the user such as favorite team, mailing address, and coin transactions on the website. The authentication and authorization module stores user credentials such as password, verified email, other login and social media connections and any other authorizations made by or for the user. The contest module stores identifications for particular contests, prizes, time data, and other such particular datum that are assigned to the contests by the administrators for their application.

The config and reference tables module store derivative data from the contest module which can be accessed by individual contests during their implementation as well as configuration data. The tournament and professional games module stores data assigned through the administrative GUI into structures which define the tournaments and their associated data like start/end time, prizes, entry limits, etc. as well as structures which store games, league, conference, and division.

The teams and statements module which is primarily referenced by the tournament and contest modules comprises structures wherein statements are stored. These include team, game, and user statements. The roles and permission scheme module store the permissions given to other modules for their ability to reference each other as well as the users' and administrators' permissions.

The spin wheel and CMS module references no other modules. The spin wheel module stores the data which is present when accessing the spin wheel via GUI. The product and subscription module stores in game and actual currency data including invoices, transactions, coin, product and subscription data. Referenced by many of the other modules, this module accounts for payments by the users for coins as well as the awarding of coins to the users for the results of tournaments.

Figure 2:
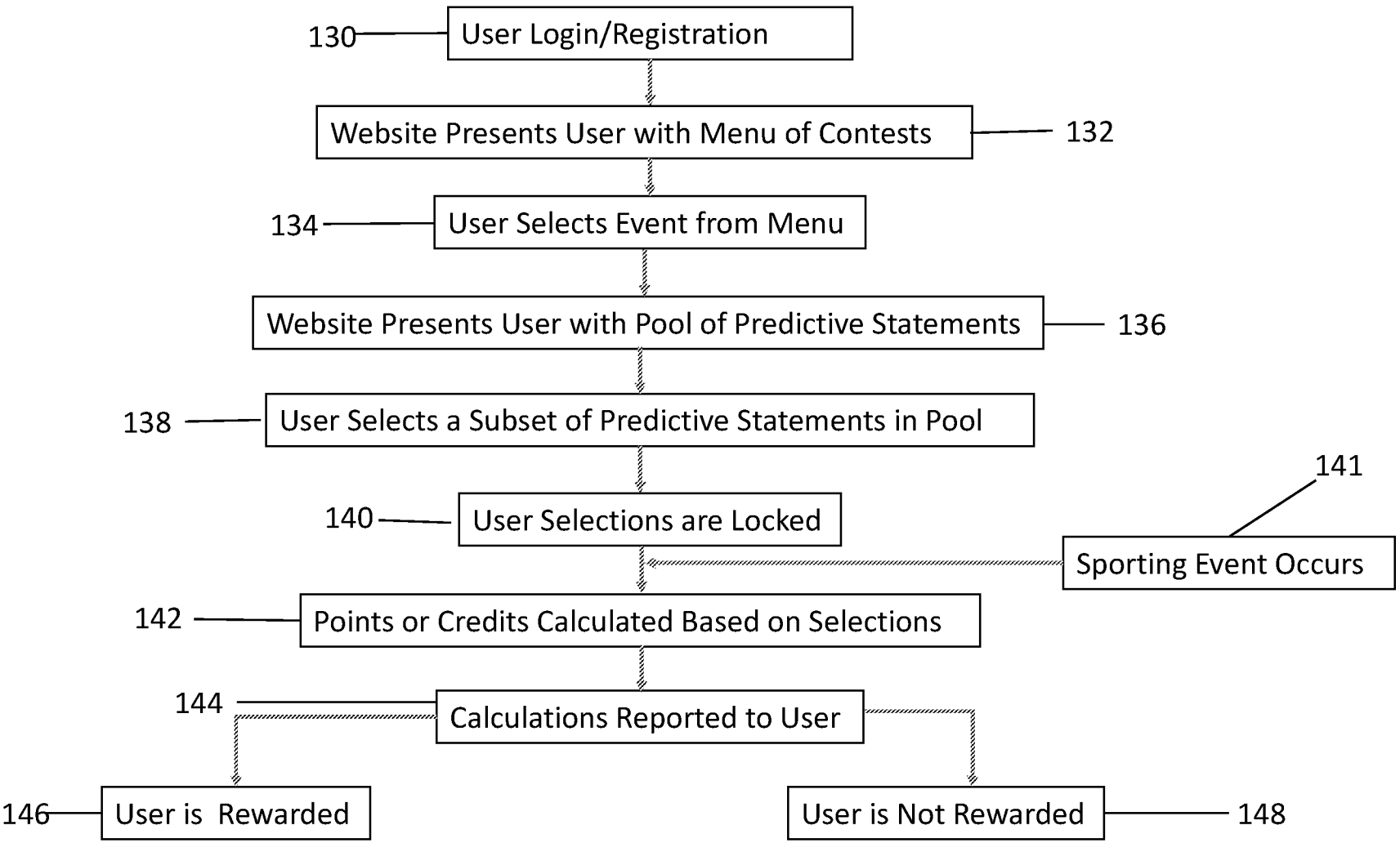
FIG. 2 shows a flow chart of the interaction between a user and the system playing the contest or tournament; and, FIG. 3 shows a flow chart of a preferred system and method of creating a contest or tournament.

Database 126 communicates and shares information with Customer Relationship Management ("CRM") 128. FIG. 2 shows the progression of steps for a user engaging with the administrator and playing the game. With respect to FIGS. 1 and 2, once the user 110 has registered with the website 122 and achieves login 130, he gains access to the content. Initially, the website 122 (working in conjunction with the administrator 124) presents the user 110 (through device 116) with a menu of potential competitive sports categories or events 132.

This menu of categories or events may be presented in a sequence of interactions or iterations between the user 110 and the website 122 (through the control of the administrator 124). For example, the user 110 may first be presented with general sport choices 132, such as "professional," "collegiate" and "non-collegiate amateur". If the user selects "professional" 134, the user will be presented with a menu providing more specific choices, such as "football," "baseball," "basketball," "hockey," and "soccer" 132. If the user chooses "football" 134, user is presented with the menu of upcoming professional football events 132. At the end of this sequence of menus and iterations, the user selects a specific competitive sporting event 134.

Alternatively, a contest or tournament may be a series of sporting events such as an entire season of a particular team or a playoff series. For example, a contest or tournament may be directed to an entire American League Championship Series or World Series. Users can be rewarded for selecting predictive statements that address the winner of the series, the duration of the series (such as five games or seven games), the most valuable player of the series, or any result that would not be known until the end of several individual events making up the series. Users can also be rewarded for selecting predictive statements relating to individual events or games within the series as described herein.

Preferably a contest is associated with a particular number of credits or points required to be paid by the user to enter the contest either directly or from the user's account. These credits are added to the user's account by the administrator at the time of user's registration, or at the time of initial login. Credits may also be traded with other users or purchased from the system or from third parties. As discussed further below, credits or points may be accumulated (or lost) as the result of playing the game. Preferably, points are the same as credits. Alternatively, points may be exchanged for credits, with one point being exchangeable for one credit, or more or less than one credit, typically at a rate that is set and does not vary over time.

Once the user 110 selects a particular event (or series of events as part of a single contest) 134, the website 122 presents the user with a pool of predictive statements relating to that event 136. This pool may contain at least two to more than a hundred predictive statements, but preferable contains a number of statements in the range of fifteen to one-hundred predictive statements, and more preferably contains thirty to seventy predictive statements. Most preferably, the pool contains about fifty predictive statements.

The user 110 uses the device 116 to select a subset of the pool of predictive statements, the selection being based on the user's agreement that the predictive statement will become true 138. For example, if Team A is playing Team B, a predictive statement in the pool says, Team A prevails over Team B. Another predictive statement in the pool says, Team B prevails over Team A. A user who believes that Team A is likely to beat Team B will select the first statement 138, and not select the second statement.

The user 110 will be required to select a certain number of predictive statements from the pool of predictive statements 138. This needs to be a smaller number than the number of predictive statements in the pool of predictive statements. For example, if the pool of predictive statements contains fifty statements, the user would preferably be required to choose ten predictive statements. If the pool of predictive statements includes forty statements, the user may be required to choose eight statements. Preferably the number of required predictive statements is about half or less than the number of predictive statements in the pool. This provides the user sufficient choices to avoid the user having to choose a statement that he personally does not agree with, or even disagrees with just to meet the required number of selected statements from the pool.

The user 110 may select predictive statements in one or more login sessions with the administrator. A user 110 may login and selects five predictive statements for a contest that requires that ten predictive statements be selected, then logs off. The next day, the user 110 may login again and select three more predictive statements, then logoff. Two days later, the user 110 may logon a third time and select another two predictive statements, completing the required selection of ten predictive statements.

The user 110, can also deselect or change predictive statements during the same or subsequent login sessions. The user can select all ten predictive statements during an initial session. If the user subsequently updates his sports knowledge with new information, such as learning of an injury to a star player, or for any other reason, he can revisit his list of selected predictive statements and decide to deselect some statements, and select others in their place, or decide not to select other statements to meet the required number of selected predictive statements.

In addition to a required number of statements, for example ten as described above, the contest can also require the user 110 to select a certain number within subcategories. For example, a contest that requires ten predictive statements, might require that the statements fall within guidelines of subcategories. For example, in one preferred embodiment, four of the ten selected predictive statements relate to a first subcategory, three of the ten statements relate to a second subcategory, two of the ten statements relate to a third subcategory, and one of the ten statements related to a forth category. For a football game, the preferred subcategories are (1) statements relating to offense, (2) statements relating to defense, (3) statements relating to special teams, and (4) statements coming from the game/bonus or other special subcategory. For a baseball game, the preferred subcategories are (1) statements relating to batting, (2) statements relating to pitching, (3) statements relating to fielding, and (4) statement coming from game/bonus or other special subcategory.

In addition to selecting the predictive statements, the user 110 also orders the statements according to the likelihood that they will become true. For example, if the contest requires ten predictive statements to be selected, the user 110 would list the ten statements from 1 to 10 (or 10 to 1) with the statement that the user 110 feels is most likely to be true listed first, and listing last the statement the user 110 believes is least likely to be true. This allows the user 110 to order the statements from the ones he is certain will become true, to those that he is confident but not certain, to those for which he has low confidence will become true and would not have been selected if only a smaller number of predictive statements were required to be selected by the contest rules.

User 110 competes with other users 112, 114 who are using devices 118 and 120, respectively, to communicate with the website 122 to play the predictive statement game. When the website 122 presents the user with competitive sporting event options 132, the website 122 indicates that the contest requires a minimum and/or maximum number of other gamers to compete. For example, user 110 selects a contest in which Team A plays Team B. The website 122 indicates that the particular contest is intended for three players to compete with each other. When user 112 and user 114 also select that same contest for Team A versus Team B, the quorum for the contest is met, and further gamers cannot join that particular contest.

There may be multiple contests for a single competitive sporting event. For the example provided above, the contest was intended for only three players to compete regarding the Team A v. Team B event. However, the website 122 may also provide another contest for more players, such as ten, to compete regarding the Team A v. Team B event. It is anticipated that better gamers, i.e., those that are better at selecting predictive statements, or who think they are, will tend to choose contests with more rather than less players. Players that compete and succeed in contests with higher numbers of users will receive greater rewards than those competing and succeeding in contests with fewer users.

The phase of the game in which the user 110 selects predictive statements and orders them ends prior to the start of the event 141. At that point, the selections of all the users 110, 112, 114, are frozen or locked 140. Each user 110, 112 and 114 has now selected the same required number of predictive statements from the pool. The pool of predictive statements includes typically predictions that are difficult or close calls. For example, if one team is a ten-point underdog, a predictive statement might not only state that that team will lose, but lose by more than ten points. This increases the likelihood that different users will select different sets of predictive statements, and reduces the likelihood that users will select the same number of predictive statements that become true.

After the contest is locked 140, and the event 141 starts, it is anticipated that the user may watch the event and learn whether or not his predictive statements become true. This is expected to add to the engagement and excitement provided by the game. For example, if the user 110 selected the predictive statement that Team A would successfully kick at least three field goals, and Team A was trying to kick a third field goal late in the fourth quarter, the user would know the prediction will be met or not based on that single play.

When the contest is locked 140, the administrator presents to each user or gamer in the contest the selections and total number of points possible for each group of predictive statements selected by each of the other users. Again, this adds to the excitement of the contest during the sporting event as a user will be able to see if a given impending action may impact not only whether one or more of his predictive statements become true but also if the predictive statement will distinguish him from others in the contest.

After the completion of the competitive sporting event the system calculates the number of true predictive statements selected by each of the users 110, 112 and 114 and awards points for predictive statements that become true 142. The system would also provide additional points or weight to the points based on factors such as the position on the list of predictive statements (as discussed above) or the deemed likelihood that a predictive statement would become true, or other factors.

As an alternative, weighing predictive statements may occur by the system at the time the predictive statements are developed and included in the pool of predictive statements. Under these circumstances, either all statements or certain statements would be designated as either particularly likely or unlikely to be true. For example, predicting that an underdog team was likely to win would be unlikely to be selected by a knowledgeable user. However, if such a statement were identified by the administrator as providing additional points or another type of bonus or reward, a user might take the relatively high risk of being incorrect if there was an associated high reward in the unlikely event the statement becomes true.

There may also be additional points provided on the basis of the number of users that participate in a contest. The preferred game would provide points for first place, second place and third place, with first place receiving the most points, and second place receiving less, and third place receiving the least of the top three. If a contest has only three users, then all will receive at least some reward points in response.

In order to properly reward the users who are relatively more competitive, the number of points would be relatively high for contests with greater numbers of users. In other words, it is expected that the competition for points among users will be greater in contests with more participants, as only the top three will receive any points and the remaining gamers will receive none. For a contest with five users, three or 60% will receive points. For a contest with ten users, the same number three receive points, but that is only 30% of the participants. Hence, in order to properly reward users to participate in contests with a greater number of users, the points awarded will need to be higher than for contests with a relatively small number of user participants. Otherwise, users who are primarily motivated to earn points may tend to unnecessarily limit themselves to contests with smaller numbers of participants.

Points may also be awarded to users who achieve certain goals over time. For example, if a user had selected an event with a certain team, such as professional football Team A, over the course of a season, and participated in a certain minimum number of contests over a single season, such as eight professional football game events, and generated a certain minimum total number of points for those eight events, he may be awarded with additional bonus points. It is anticipated that the award of additional bonus points for performance over a season or part of a season would be particularly appropriate for playoffs or in the case of professional baseball, a World Series.

After the points are calculated, the system notifies the users 110, 112, 114 of the results of the contest 144. The users would be informed as to whether they ranked first, second or third in the contest and the number of points that the user was awarded. For a user achieving a certain place, such as first place, or a certain number of points, or attaining some other goal, he might receive a prize 146. For users that do not achieve a certain place, number of points or other goals, no prize would be awarded 148.

The predictive statements can be generated by a number of methods. If developed by an individual, they would be input into the database 126 for communication to the administrator 124 and incorporated by the administrator 124 into the appropriate pool of statements presented 136 to the user 110. It is anticipated that some or all of the predictive statements will be generated in whole or in part by software operated by computers electronic peripherals. A large amount of sports information is generated every day for professional and collegiate sports. Such information could be input into a database with software that would use the information to generate a series of predictive statements for every professional and significant collegiate sporting event. A contest could be created for those events where a sufficient number of predictive statements have been developed by operation of software within the administrator without input by individual personnel.

Figure 3:
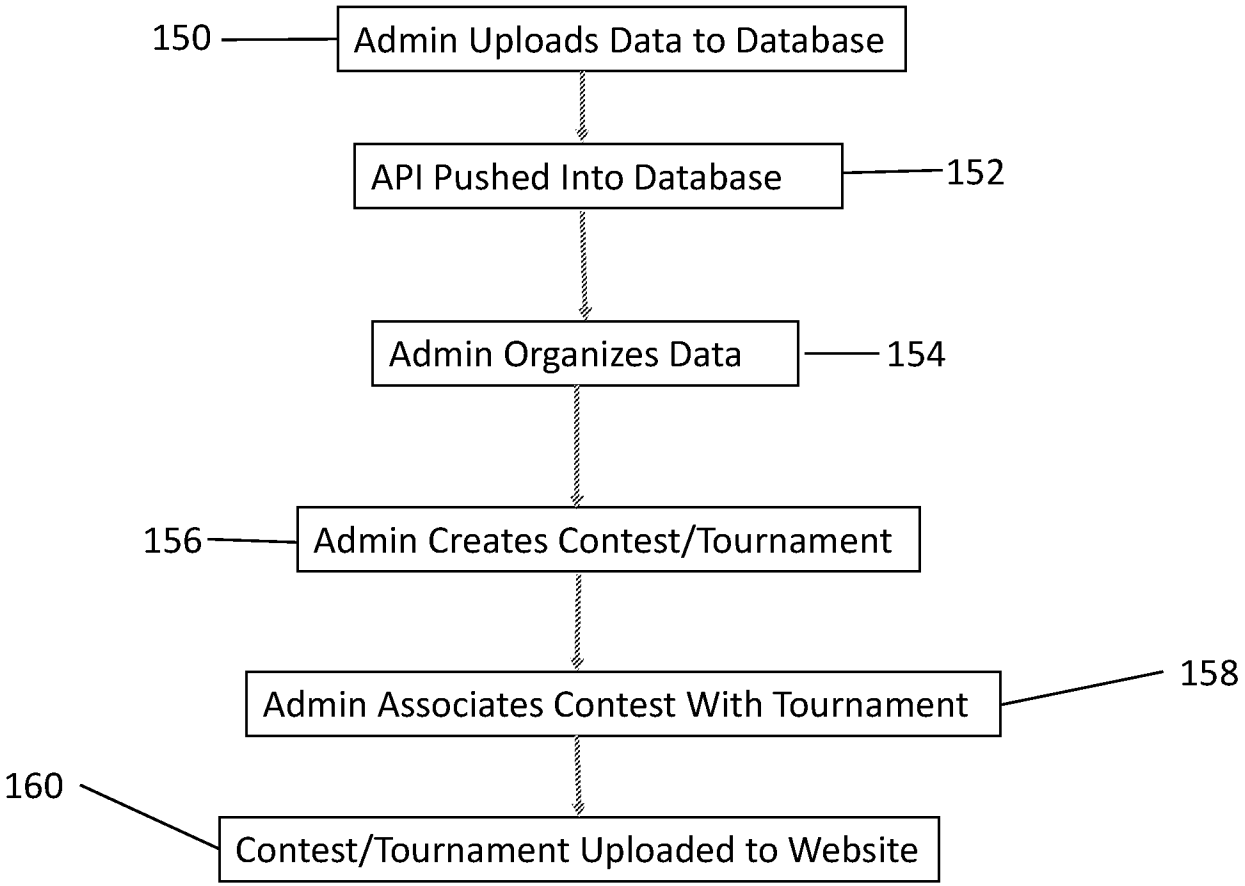

A preferred system and method for generating contests or tournaments is shown in FIG. 3. As shown in FIG. 1, Admin 124 is in communication with Database 126. Data for creating contests can be done in a variety of ways. Preferably the Admin 124 uploads 150 data relating to competitive sporting events directly to the Database 126. For example, "Quarterback Alpha Passes for OVER 250 yards."

An application program interface (API) is pushed 152 in the Database 126. The system requests data from a third party and via an API can push data into the Database 126. For example, the system requests information from third party about the amount of yardage of Quarterback Alpha is expected to pass in an upcoming game. Data that is obtained is uploaded into the Database 126.

Next, the Amin 124 organizes 154 the data in the Database 126. Specifically, various data relating to a single competitive event, or a series of connected competitive events, as discussed above, is organized to create a contest or tournament. The contest includes a pool of predictive statements about the event or series.

During or after the Admin 124 organizes the data regarding the event or events, the Admin 124 creates 156 a contest or tournament, setting certain parameters or criteria that are contest or tournament specific. For example, contests and tournaments limit the number of participants that can join a given contest or tournament. Also, the date and time when a contest or tournament is opened and available to be selected by the user or gamer. In addition, the prizes, points or credits to be awarded are assigned to particular contests.

In the event that a contest is part of a tournament, the Admin 124 associates 158 a contest as part of a tournament. The contests and tournaments work hand-in-hand. Finally, contests and/or tournaments are uploaded 160 to the website 122 for selection by the user. Once uploaded the contests and/or tournaments are considered to be published and are available to be viewed and played by users or gamers.

It is further anticipated that advanced software, statistical and artificial intelligence techniques can be used to develop predictive statements for contests as well as other aspects of contests. For example, automatic input of publicly-available, or purchased real-time data from professional handicappers and odds-makers, as well as sportscasters, podcasts, columnists, bloggers and others with knowledge could inform the predictive statements to assure that either they are very close to having even odds of becoming true. It might also be useful for calculating the likelihood of certain statements and applying the appropriate weighing standard for each statement that would not have even-odds of coming true.

Similarly, advanced software, statistical and artificial intelligence techniques could review database information about the particular patterns and tendencies of certain users and direct them to certain events, or invite them to invitationals including other users have similar predictive abilities. For example, if patterns were discovered that indicated that a particular user had substantial success selecting predictive statements with respect to Team A, but poor performance selecting predictive statements with respect to Team B, he could be matched with a person having the opposite history. In other words, if Team A played Team B, two users having opposite predictive histories could be matched against each other.

The invention also contemplates that contests could be created for competitive sporting events that otherwise would be too local or otherwise would not get widespread attention in the sports world. For example, high school football rivals might play each other. Friends who previously attended each of the high schools may want to input their own predictive statements relating to that high school game and have access to a relatively small group who would be interested. A user or group of users could enter their own pool of customized predictive statements related to the rivalry event, and develop their own associated criteria for the contest, such as the minimum and/or maximum number of users and required number of selected statements. Further, access might be limited to a set of friends or users within a defined group (i.e., alumni of the high schools) who plan to tailgate or attend the event together, or who are competing for bragging rights at the end of the event.

EXAMPLE 1

A professional football fan with greater knowledge of the NFC East division than the AFC teams of other teams in the NFC is interested in predicting outcomes and events in upcoming East division rivalry games, and to test that that ability against one or more others. The fan finds the website and registers with that website, and logs on 130 as a user. Upon registration, the user provides credit card information to create an account and the administrator provides the user's account with an initial amount of points or credits to be used to join contests.

The website 122 presents the user 110 with a menu of contests 132, each relating to a specific upcoming competitive sporting event. Each contest is identified by a particular sporting event and associated with a certain number of points or credits needed to be "paid" in order to join. The number of points or credits required to be "paid" may vary for a number or factors. For example, the number or credits required may reflect the difficulty of the predictive statements, the minimum and/or maximum number of users allowed to participate in the contest, or other factors.

Included in the menu provided to user 110 are the following contests:

- New York Giants versus Dallas Cowboys—1 Credit (two users)
- New York Giants versus Dallas Cowboys—5 Credits (three users)
- New York Giants versus Dallas Cowboys—10 Credits (ten users)
- Green Bay Packers versus Chicago Bears—1 Credit (two users)
- Green Bay Packers versus Chicago Bears—5 Credits (three users)
- Green Bay Packers versus Chicago Bears—10 Credits (ten users)
- San Francisco 49ers versus Seattle Seahawks—1 Credit (two users)
- San Francisco 49ers versus Seattle Seahawks—5 Credits (three users)
- San Francisco 49ers versus Seattle Seahawks—10 Credits (ten users)

Because one of the contests on the menu is identified as relating to the upcoming professional football sporting event New York Giants versus Dallas Cowboys, both NFC East division teams, user 110 is particularly interested in those contests in particular. In addition to identifying the contest as having three users, provides ten points to the winner (addition to the points for each predictive statement as explained further below). User 110 decides to "pay" five credits for the contest for the Giants v. Dallas event that has a three-user limit. User 110 selects 134 that contest and the system deducts five credits from the account of user 110.

The website 122 presents the user 110 on the user's device 116 with a pool of predictive statements for the contest 136, all of the predictive statements relate to the Giants v. Cowboys event. The contest is identified by the website 122 as requiring the selection of predictive statements in the following subcategories: (1) four statements relating to offense, (2) three statements relating to defense, (3) two statements relating to special teams, and (4) one special bonus predictive statement.

The user 110 selects the following predictive statements (each showing the subcategory of the predictive statement and the number of points attributable to the user if the predictive statement becomes true) 138:

1. (Offensive) NYG QB will throw for over 300 Passing Yards. (2 PTS)
2. (Offensive) DAL QB will rush for a TD. (4 PTS)
3. (Offensive) DAL starting offense will be penalized for over 45 YRDS. (1 PT)
4. (Offensive) NYG RB will rush for over 100 YRDS. (3 PTS)
5. (Defensive) DAL DEF unit will force over 2½ turnovers. (3 PTS)
6. (Defensive) NYG DEF will sack DAL QB over 2½ times. (3 PTS)
7. (Defensive) NYG DEF will obtain a Defensive score. (4 PTS)
8. (Special Teams) NYG Kicker will kick a FG over 35 Yards. (1 PT)

9. (Special Teams) DAL will recover an onside kick. (4 PT)
10. (Special Bonus) Total points scored by NYG and DAL is under 50. (1 PT)

User 112 using device 118 selects 134 the same contest, is presented 136 with the same pool of predictive statements as user 110, and selects 138 his own group of predictive statements. User 114 using device 120 selects 134 the same contest, is presented 136 with the same pool of predictive statements as users 110 and 112, and selects 138 his own group of predictive statements. These three users are now matched against each other in the contest.

Users 112 and 114, like user 110, have made the requisite four offensive predictive statements, three defensive predictive statements, two special teams predictive statements, and one special bonus predictive statement. Each of the users 110, 112, 114 have chosen some of the same predictive statements, but also some unique predictive statements among the three. Each group of predictive statements is unique among the three. As preferably the statements are typically about as likely to become true as not, some of the chosen predictive statements are opposites. For example, users 110 and 112 have selected the predictive statement that the Giants would prevail, while user 114 have selected the predictive statement that the Cowboys would prevail. (As a tie is possible but unlikely in professional football, there was no statement in the pool predicting a tie.)

As this contest associated with the upcoming Giants v. Cowboys event now has the requisite three users 110, 112 and 114, no additional users will be allowed to join or otherwise be a part of that contest. The menu of available contests may include other contests (having a cut-off of three or some other number of users) with predictive statements relating to the same upcoming Giants v. Cowboys sporting event. Five minutes prior to the scheduled start of the game the contest is locked 140. Users 110, 112 and 114 cannot change their selections of predictive statements after the contest is locked. At this point, the administrator makes available the selections of all the other users and points associated with those selections to all the other users in the contest.

At the conclusion of the event, the system identifies the correct predictive statements of the groups selected by the three users and calculates 142 the number of points associated with each of the user's lists. The points for each group are added. For example, the group of selected predictive statements for user 110 included the following true predictive statements: No. 1 (3 pts), No. 2 (4 pts), No. 3 (1 pt), No. 5 (3 pts), No. 7 (4 pts), No. 9 (4 pts) and No. 10 (1 pt). The system calculates the total points associated with this user's group as 3+4+1+3+4+4+1=twenty points. In addition, as the group selected by user 110 scored more total points than the groups selected by user 112 and user 114, user 110 was awarded an additional ten points, for a total award of thirty points (twenty for the group plus ten for winning the contest). The system adds thirty points or credits to the account of user 110.

The group of statements selected by user 112 accumulated the second highest number of points. As a result, it is awarded those points plus five additional points for coming in second in the contest behind user 110 and in front of user 114. The system adds the awarded total number of points or credits to the account of user 112.

The group of statements selected by user 114 accumulated the third and lowest number of the three users in the contest. As a result, user 114 is awarded the total number of points of true statements in his group of selected predictive statements, as well as an award of one additional point for coming in third. The system adds the awarded total number of points or credits to the account of user 114.

EXAMPLE 2

A professional football fan desires to test his ability against one or more others. The fan finds the website and registers with that website, and logs on 130 as a user. Upon registration, the system provides the user's account with twenty-five points or credits to be used to join contests.

The website 122 presents the user 110 with a menu of contests 132, each relating to a specific upcoming competitive sporting event. Included in the menu provided to user 110 are the following contests:

Baltimore Ravens versus Pittsburgh Steelers—1 Credit (two users)
Baltimore Ravens versus Pittsburgh Steelers—10 Credits (five users)
Baltimore Ravens versus Pittsburgh Steelers—20 Credits (ten users)
Minnesota Vikings versus Tampa Bay Bucs—1 Credit (two users)
Minnesota Vikings versus Tampa Bay Bucs—10 Credits (five users)
Minnesota Vikings versus Tampa Bay Bucs—20 Credits (ten users)
Los Angeles Rams versus Arizona Cardinals—1 Credit (two users)
Los Angeles Rams versus Arizona Cardinals—10 Credits (five users)
Los Angeles Rams versus Arizona Cardinals—20 Credits (ten users)

User 110 chooses Vikings versus Bucs for 20 credits. In addition to identifying the contest as having ten users, provides twenty points to the winner (in addition to the points for each predictive statement as explained further below); provides ten points to the second place user; and five points for the third place user. User 110 decides to "pay" twenty credits for the contest for the Vikings v. Buc event that has a ten-user limit. User 110 selects 134 that contest and the system deducts twenty credits from the account of user 110.

The website 122 presents the user 110 on the user's device 116 with a pool of predictive statements for the contest 136, all of the predictive statements relate to the Vikings v. Bucs event. In this contest, the website 122 presents to the user 110 on the display 116 a pool of twenty-six predictive statements. The contest requires the user 110 to select thirteen of the twenty-six predictive statements. Further, the contest requires the user 110 to make the required number of selections in each of the following subcategories: (1) two statements relating to the quarterbacks, (2) two statements relating to the running backs, (3) three statements relating to the wide receivers, (4) two statements relating to the tight ends, (5) two statements relating to the kickers, and (6) two statements relating to the defenses. The twenty predictive statements in various above identified five subcategories are:

Subcategory 1: Quarterbacks (Pool Presented to User)

Vikings starting quarterback will throw for over 300 yards (1 pt).
Vikings starting quarterback will throw over 1.5 touchdown passes (2 pts).
Bucs starting quarterback will rush over 0.5 touchdowns (3 pts).
Bucs starting quarterback will not throw a passing interception (4 pts).

Subcategory 2: Running Backs (Pool Presented to User)
- Vikings starting running back will rush for over 100 yards (1 pt).
- Vikings starting running back will catch over five passes (2 pts).
- Bucs starting running back will rush for over 100 yards (2 pts).
- Bucs starting running back will rush for over 0.5 touchdowns (3 pts).

Subcategory 3: Wide Receivers (Pool Presented to User)
- Vikings wide receivers combine for over 225 yards (1 pt).
- Vikings wide receivers combine for over twenty-five completions (2 pts).
- Vikings wide receivers combine for over 1.5 touchdown receptions (3 pts).
- Bucs wide receivers combine for over 275 yards (2 pt).
- Bucs wide receivers combine for over twenty-five completions (2 pts).
- Bucs wide receivers combine for no touchdown receptions (3 pts).

Subcategory 4: Tight Ends (Pool Presented to User)
- Vikings starting tight end will have over six receptions (1 pt).
- Vikings starting tight end will have over twenty-five yards (2 pts).
- Bucs starting tight end will score a passing touchdown (1 pts).
- Bucs starting tight end will commit over 0.5 holding penalties (3 pts).

Subcategory 5: Kickers (Pool Presented to User)
- Vikings kicker will complete a field goal of over twenty-five yards (1 pt).
- Vikings kicker will complete a field goal of over fifty yards (4 pts).
- Bucs kicker will miss a field goal of less than fifty years (1 pt).
- Bucs kicker will complete a field goal of over twenty-five yards (1 pt).

Subcategory 6: Defense (Pool Presented to User)
- Vikings defense will allow over one-hundred rushing yards (1 pt).
- Vikings defense will give up over twenty-five points (3 pts).
- Bucs defense will record over 2.5 sacks (2 pts).
- Bucs defense will record over 1.5 turnovers (4 pts).

The user 110 selects 138 the following predictive statements (showing the subcategory of the predictive statement and the total number of possible points attributable to if all selected statements in that subcategory become true):

Subcategory 1: Quarterbacks (Selected Predictive Statements)
- Vikings starting quarterback will throw for over 300 yards (1 pt).
- Bucs starting quarterback will not throw a passing interception (4 pts).

Total if predictive quarterback related statements become true is 5 points.

Subcategory 2: Running Backs (Selected Predictive Statements)
- Bucs starting running back will rush for over 100 yards (2 pts).
- Bucs starting running back will rush for over 0.5 touchdowns (3 pts).

Total if predictive running back related statements become true is 5 points.

Subcategory 3: Wide Receivers (Selected Predictive Statements)
- Vikings wide receivers combine for over twenty-five completions (2 pts).
- Bucs wide receivers combine for over twenty-five completions (2 pts).
- Bucs wide receivers combine for no touchdown receptions (3 pts).

Total if predictive wide receiver related statements become true is 7 points.

Subcategory 4: Tight Ends (Selected Predictive Statements)
- Vikings starting tight end will have over six receptions (1 pt).
- Bucs starting tight end will commit over 0.5 holding penalties (3 pts).

Total if predictive tight end related statements become true is 4 points.

Subcategory 5: Kickers (Selected Predictive Statements)
- Bucs kicker will miss a field goal of less than fifty years (1 pt).
- Bucs kicker will complete a field goal of over twenty-five yards (1 pt).

Total if predictive kicker related statements become true is 2 points.

Subcategory 6: Defense (Selected Predictive Statements)
- Vikings defense will give up over twenty-five points (3 pts).
- Bucs defense will record over 1.5 turnovers (4 pts).

Total if predictive defense related statements become true is 7 points.

User 110 has the ability to substitute any of the selected thirteen predictive statements with any of the thirteen predictive statements in the pool of statements that are not currently in the group of selected predictive statements. This ability closes when the contest is locked 140 five minutes prior to kickoff. If no changes are made, the user 110 has the ability to earn as many as twenty-nine points from the accumulated statements if they all become true. At this point each of the ten users participating in this contest will be able to see the predictive statements groups of each of the other nine users and the points associated with each of those groups.

User 112 using device 118 selects 134 the same contest, is presented 136 with the same pool of predictive statements as user 110, and selects 138 his own group of predictive statements. User 114 using device 120 selects 134 the same contest, is presented 136 with the same pool of predictive statements as users 110 and 112, and selects 138 his own group of predictive statements. These three users are now matched against each other in the contest.

Users 112 and 114, like user 110, have made the requisite predictive statements in each of the six subcategories. When the contest associated with the upcoming Vikings versus Bucs event has the requisite ten users no additional users will be allowed to join or otherwise be a part of that contest.

Each of the users 110, 112, 114 have chosen some of the same predictive statements, but also some unique predictive statements among the three. Preferably the statements are about as likely to become true as not. This makes it more likely that even relatively large groups of highly skilled and competent users in a single contest will chose different groups of predictive statements. Statistically, there are an immense number of possible combinations of groups of thirteen from a pool of twenty-six choices, particularly if the likelihood of selecting each of the twenty-six statements is even.

After the conclusion of the event, the system identifies the correct predictive statements of the groups selected by the ten users and calculates 142 the number of points associated with each of the user's lists. The points for each group are added. The system calculates the total points associated with each group selected by each of the ten users in the contest. As the group selected by user 110 scored more total points than the groups selected by the other nine users participating in the contest, user 110 was awarded the points associated with the statements that became true (up to a possible 29 points) and an additional twenty points for winning the contest. The system adds the total points or credits to the account of user 110.

The group of statements selected by user 112 accumulated the second highest number of points of the ten users. As a result, it is awarded those points plus ten additional points for coming in second in the contest behind user 110. The system adds the awarded total number of points or credits to the account of user 112.

The group of statements selected by user 114 accumulated the third highest number of the ten users. As a result, user 114 is awarded the total number of points of true statements in his group of selected predictive statements, as well as an award of five additional point for coming in third. The system adds the awarded total number of points or credits to the account of user 114.

The systems and methods described above are examples of systems and methods falling within the scope of the subject matter described herein and are not intended to limit the scope of the invention as recited in the following claims. Specific details, even if helpful to the understanding and practice of the subject matter, are not intended to be incorporated into the claims unless specifically recited in the claims.

What is claimed is:

1. A gaming system for rewarding the ability of a user operating a device connected to the internet to predict aspects and outcomes of a future competitive sporting event, the system comprising:

a server connected to the internet and operating the gaming system;

a device under the control of a user, the device communicating with the server through the internet and capable of responding to prompts generated by the server;

wherein the server is configured to:

generate a pool of at least two predictive statements in each of at least two subcategories about a future sporting event for presentation to the device;

receive responses from a user operating the device identifying at least some of the pool of predictive statements in each subcategory;

subsequent to the competitive sporting event determine whether the identified predictive statements become true or not;

generate a response to the device based on the merits of the predictions; and, reward the user based on the merits of the predictions.

2. The gaming system of claim 1 wherein the server is configured to receive responses from the user identifying a predetermined number of predictive statements in the pool of predictive statements.

3. The gaming system of claim 1 further comprising a second device operated by a second user communicating with the server through the internet, the device capable of responding to prompts generated by the server;

wherein the server generates a pool of predictive statements about a future sporting event for presentation to the second device;

receive responses from the second user operating the second device identifying some of the pool of predictive statements;

subsequent to the competitive sporting event determine whether the identified predictive statements submitted by the second user become true or not;

generate a response to the second device based on the merits of the predictions; and, reward the user based on the merits of the predictions.

4. The gaming system of claim 3 wherein the server is further configured to compare the merits of the predictions received from the first and second devices.

5. The gaming system of claim 4 wherein the server is configured to reward the user operating the device based on the comparison of the merits of the predictions.

6. The gaming system of claim 1 wherein the server is configured to reward the user based on the likelihood the identified predictive statement would become true.

7. The gaming system of claim 1 wherein the pool of predictive statements relates to a contest between two teams, and the statements are chosen from the group consisting of a criteria for individual player performance, a final score of one team, an identification of a prevailing team, an event occurring during the contest, and a combination of two or more of the above criteria.

8. A gaming system for rewarding the ability of a user operating a device connected to the internet to predict aspects and outcomes of a future competitive sporting event, the system comprising:

a server connected to the internet and operating the gaming system;

a device under the control of a user, the device communicating with the server through the internet and capable of responding to prompts generated by the server;

wherein the server is configured to:

generate a pool of predictive statements about a future sporting event for presentation to the device;

receive responses from a user operating the device identifying some of the pool of predictive statements;

subsequent to the competitive sporting event determine whether the identified predictive statements become true or not;

generate a response to the device based on the merits of the predictions; and, reward the user based on the merits of the predictions;

wherein the server is configured to receive responses from the device that order the identified predictive statements, and wherein the server is configured to reward the user based both on whether the predictive statement becomes true and the position of the predictive statement in the order of identified predictive statements.

9. The gaming system of claim 8 wherein the server is configured to provide a higher weight to a true identified predictive statement that is ordered ahead of another true identified predictive statement.

10. A modifiable sports gaming system for rewarding the ability of a user operating a device connected to the internet to accurately predict aspects and outcomes of a future sporting event, the system comprising:

a server connected to the internet and operating the gaming system;

a device under the control of a user, the device communicating with the server through the internet and capable of responding to prompts generated by the server;

wherein the server is configured to:

receive predictive statements generated by a user or users about a future sporting event;

generate a pool of at least two predictive statements in each of at least two subcategories about the future sporting event from the predictive statements received from the user or users;

present the pool of predictive statements to a user;

receive responses from a user operating the device identifying at least some of the pool of predictive statements in each subcategory;

subsequent to the competitive sporting event determine whether the identified predictive statements become true or not;

generate a response to the device based on the merits of the predictions; and, reward the user based on the merits of the predictions.

11. The gaming system of claim 10 wherein the server is configured to receive responses from the user identifying a predetermined number of predictive statements in the pool of predictive statements.

12. The gaming system of claim 10 further comprising a second device operated by a second user communicating with the server through the internet, the device capable of responding to prompts generated by the server;

wherein the server generates a pool of predictive statements about a future sporting event for presentation to the second device;

receive responses from the second user operating the second device identifying some of the pool of predictive statements;

subsequent to the competitive sporting event determine whether the identified predictive statements submitted by the second user become true or not;

generate a response to the second device based on the merits of the predictions; and, reward the user based on the merits of the predictions.

13. The gaming system of claim 12 wherein the server is further configured to compare the merits of the predictions received from the first and second devices.

14. The gaming system of claim 13 wherein the server is configured to reward the user operating the device based on the comparison of the merits of the predictions.

15. The gaming system of claim 10 wherein the server is configured to reward the user based on the likelihood the identified predictive statement would become true.

16. The gaming system of claim 10 wherein the pool of predictive statements relates to a contest between two teams, and the statements are chosen from the group consisting of a criteria for individual player performance, a final score of one team, an identification of a prevailing team, an event occurring during the contest, and a combination of two or more of the above criteria.

17. A modifiable sports gaming system for rewarding the ability of a user operating a device connected to the internet to accurately predict aspects and outcomes of a future sporting event, the system comprising:

a server connected to the internet and operating the gaming system;

a device under the control of a user, the device communicating with the server through the internet and capable of responding to prompts generated by the server;

wherein the server is configured to:

receive predictive statements generated by a user or users about a future sporting event;

generate a pool of at least two predictive statements in each of at least two subcategories about the future sporting event from the predictive statements received from the user or users;

present the pool of predictive statements to a user;

receive responses from a user operating the device identifying at least some of the pool of predictive statements in each subcategory;

subsequent to the competitive sporting event determine whether the identified predictive statements become true or not generate a response to the device based on the merits of the predictions; and, reward the user based on the merits of the predictions;

wherein the server is configured to receive responses from the device that order the identified predictive statements, and wherein the server is configured to reward the user based both on whether the predictive statement becomes true and the position of the predictive statement in the order of identified predictive statements.

18. The gaming system of claim 17 wherein the server is configured to provide a higher weight to a true identified predictive statement that is ordered ahead of another true identified predictive statement.

* * * * *